US009475084B2

(12) United States Patent
Frenkel et al.

(10) Patent No.: US 9,475,084 B2
(45) Date of Patent: Oct. 25, 2016

(54) PAINTING APPARATUS COMPRISING AN AIR BAG

(71) Applicant: NIRLAT LTD, D.N. Negev (IL)

(72) Inventors: Oded Frenkel, Hod-Hasharon (IL); Oren Moshe, Bat Hefer (IL); Shiri Zakai, Hod Hasharon (IL); Juda Kaplun, Kibutz Nirim (IL); Tami Marcovich, Kochav-Yair (IL); Boris Grinspan, Kibutz Sde-Yoav (IL); Ben Josef Yehuda, Mosav Ein Habsor (IL); Tal Leizer, Shefayim (IL); Shlomi Eiger, Cfar Saba (IL); Roi Vaspi Yanai, Tel Aviv (IL); Meir Bareli, Kiryat-Ata (IL); Amichai Yifrach, Kedumim (IL)

(73) Assignee: NIRLAT LTD, D.N. Negev (IL)

( * ) Notice: Subject to any disclaimer, the term of this patent is extended or adjusted under 35 U.S.C. 154(b) by 0 days.

(21) Appl. No.: 14/558,759

(22) Filed: Dec. 3, 2014

(65) Prior Publication Data

US 2016/0158792 A1 Jun. 9, 2016

(51) Int. Cl.

| | |
|---|---|
| ***B05C 11/10*** | (2006.01) |
| ***B05C 17/03*** | (2006.01) |
| ***B05C 17/005*** | (2006.01) |
| ***B05C 17/00*** | (2006.01) |
| ***B05B 9/047*** | (2006.01) |

(Continued)

(52) U.S. Cl.

CPC ..... *B05C 17/0325* (2013.01); *B05B 9/047* (2013.01); *B05B 9/0811* (2013.01); *B05B 9/0816* (2013.01); *B05B 9/0838* (2013.01); *B05C 11/1002* (2013.01); *B05C 17/002* (2013.01); *B05C 17/00569* (2013.01); *B05C 17/00573* (2013.01); *B05C 17/0146* (2013.01); *B05C 17/0316* (2013.01); *B05C 17/0333* (2013.01); *B05B 9/0888* (2013.01); *B05C 17/0308* (2013.01)

(58) Field of Classification Search

CPC ..... B05C 11/1002; B05C 17/002; B05C 17/00569; B05C 17/00573; B05C 17/03; B05C 17/0316; B05C 17/0333; B05B 9/047

See application file for complete search history.

(56) References Cited

U.S. PATENT DOCUMENTS

| | | | |
|---|---|---|---|
| 141,522 | A | 8/1873 | Thompson |
| 2,882,542 | A | 4/1959 | Martin |
| 2,932,043 | A | 4/1960 | Bischoff |

(Continued)

FOREIGN PATENT DOCUMENTS

| | | |
|---|---|---|
| CH | 480198 | 10/1969 |
| EP | 0830901 | 3/1998 |

(Continued)

OTHER PUBLICATIONS http://www.walmart.com/ip/Wagner-SMART-Edge-Roller/23034616.

*Primary Examiner* — Dah-Wei D Yuan
*Assistant Examiner* — Stephen Kitt
(74) *Attorney, Agent, or Firm* — Soroker Agmon Nordman

(57) ABSTRACT

The subject matter discloses a painting apparatus comprising a paint bag containing paint; a paint port through which paint flows from the paint bag; an air bag to receive gas configured to apply pressure to the paint bag as it receives air; an air port through which the gas enters the air bag; wherein the air bag and the paint bag are located within the painting apparatus, such that expansion of the air bag by pumping of the gas into the air bag forces the paint from the paint bag via the paint port.

12 Claims, 8 Drawing Sheets

(51) Int. Cl.
*B05B 9/08* (2006.01)
*B05C 17/01* (2006.01)

(56) References Cited

U.S. PATENT DOCUMENTS

| | | | | |
|---|---|---|---|---|
| 3,070,825 | A | 1/1963 | Martin | |
| 3,304,573 | A | 2/1967 | Stefely | |
| 3,960,294 | A | 6/1976 | Bernard | |
| 4,328,843 | A | 5/1982 | Fujii | |
| 5,797,520 | A * | 8/1998 | Donahue | B05B 9/047 222/386.5 |
| 5,935,659 | A * | 8/1999 | Cane et al. | 427/428.19 |
| 6,206,599 | B1 | 3/2001 | Buchanan | |
| 6,712,238 | B1 * | 3/2004 | Mills | 222/61 |
| 6,742,950 | B1 | 6/2004 | Coombs | |
| 7,556,447 | B2 | 7/2009 | Bruggeman et al. | |
| 2012/0224909 | A1 | 9/2012 | Saravia Castillon | |
| 2014/0203039 | A1 | 7/2014 | Maas | |

FOREIGN PATENT DOCUMENTS

| | | |
|---|---|---|
| EP | 0830902 | 3/1998 |
| EP | 0830903 | 10/1998 |
| GB | 1262552 | 2/1972 |
| GB | 2380149 | 4/2003 |

* cited by examiner

PAINTING APPARATUS COMPRISING AN AIR BAG

FIELD OF THE INVENTION

The subject matter relates generally to a painting apparatus enabling even distribution of paint onto a surface.

BACKGROUND OF THE INVENTION

A paint roller is well known in the art for painting objects and structures, for example a wall of a house. The roller requires paint to be distributed along the roller to enable painting an even coat over the object that is being painted. Various apparatuses have been created to better distribute the paint on the roller from a paint bag. For example, a roller that comprises a motor that pumps paint from a paint bag. In some cases, the roller comprises a button that is used to pour the paint onto the roller through a pipe. Some painting devices enable squeezing a paint tube in which the paint is stored. The paint tube compresses causing the paint inside to flow out and onto a paint roller or paint brush.

SUMMARY

It is an object of the subject matter to disclose a painting apparatus comprising a paint bag containing paint; a paint port through which paint flows from the paint bag; an air bag to receive gas configured to apply pressure to the paint bag as it receives air; an air port through which the gas enters the air bag; wherein the air bag and the paint bag are located within the painting apparatus, such that expansion of the air bag by pumping of the gas into the air bag forces the paint from the paint bag via the paint port.

In some cases, the painting apparatus further comprises a paint tube to convey paint from the paint port to a paint accessory that distributes the paint onto a surface.

In some cases, the painting apparatus further comprises a paint accessory to distribute paint onto a surface.

In some cases, the painting apparatus further comprises a pressure valve connected to the air port, wherein the pressure valve is opened or closed depending on the pressure of the gas within the air bag.

In some cases, the painting apparatus further comprises a mechanical pump having a pressing element, said mechanical pump is used to introduce air into the air bag.

In some cases, the painting apparatus further comprise a pump device connected to the air port to introduce air into the air bag, said pump device comprises: a pump for pumping the gas via the air port into the air bag; an electric switch to activate and deactivate the pump; an energy source; an pressure control mechanism that moves according to gas pressure in the air bag; wherein the electric switch activates the pump when the pressure control mechanism moves a predetermined distance.

In some cases, the electric switch is activated at predetermined time increments.

In some cases, the pump device comprises an activation switch to enable activation of the pump device.

In some cases, the electric switch deactivates the pump when the pressure control mechanism is at a pressure control mechanism original location.

In some cases, the painting apparatus further comprises a shoulder straps for carrying the paint apparatus.

It is another object of the subject matter to disclose a stopper of a paint port, comprising: an external stopper rotateably inserted into the paint port; an internal stopper inserted into a port of the external stopper; a paint valve to enable paint to flow from a paint bag of a paint apparatus to a paint accessory.

In some cases, the paint valve further comprises a valve paint tube for connecting a paint tube to the paint stopper, said paint tube flowing the paint from the stopper to the paint accessory.

In some cases, the paint valve comprises a valve knob for controlling the flow of paint through the paint valve.

In some cases, the internal stopper is inserted into the external stopper after a paint base is poured into a paint bag of the paint apparatus.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The subject matter relates generally to a painting apparatus enabling distribution of paint onto a surface, according to exemplary embodiments.

One technical problem dealt by the disclosed subject matter is providing a paint accessory, such as a paint roller with paint, without the need to dip the paint roller into a paint source, such as a paint bucket, while painting a surface. Another technical problem dealt with the disclosed subject matter is providing a paint accessory with continuous paint flow from a paint source. Yet another technical problem dealt with the disclosed subject matter is providing a paint source that can provide paint to a paint accessory on demand.

One technical solution according to the disclosed subject matter is a painting apparatus, which comprises the paint accessory connected to the painting apparatus. The painting apparatus comprises a paint bag having a tube attached thereto, to convey the paint from the paint bag to the paint accessory. The painting apparatus also comprises an air bag attached or connected to the paint bag, such that when air is delivered into the air bag the expansion of the air bag results in pressure onto the paint bag, forcing paint to exit the paint bag through a paint tube, the paint flows towards the paint accessory. A user of the painting apparatus controls an air pump to pump air into the air bag. Alternatively, air or another gas is pumped into the paint bag automatically.

Figure 1:
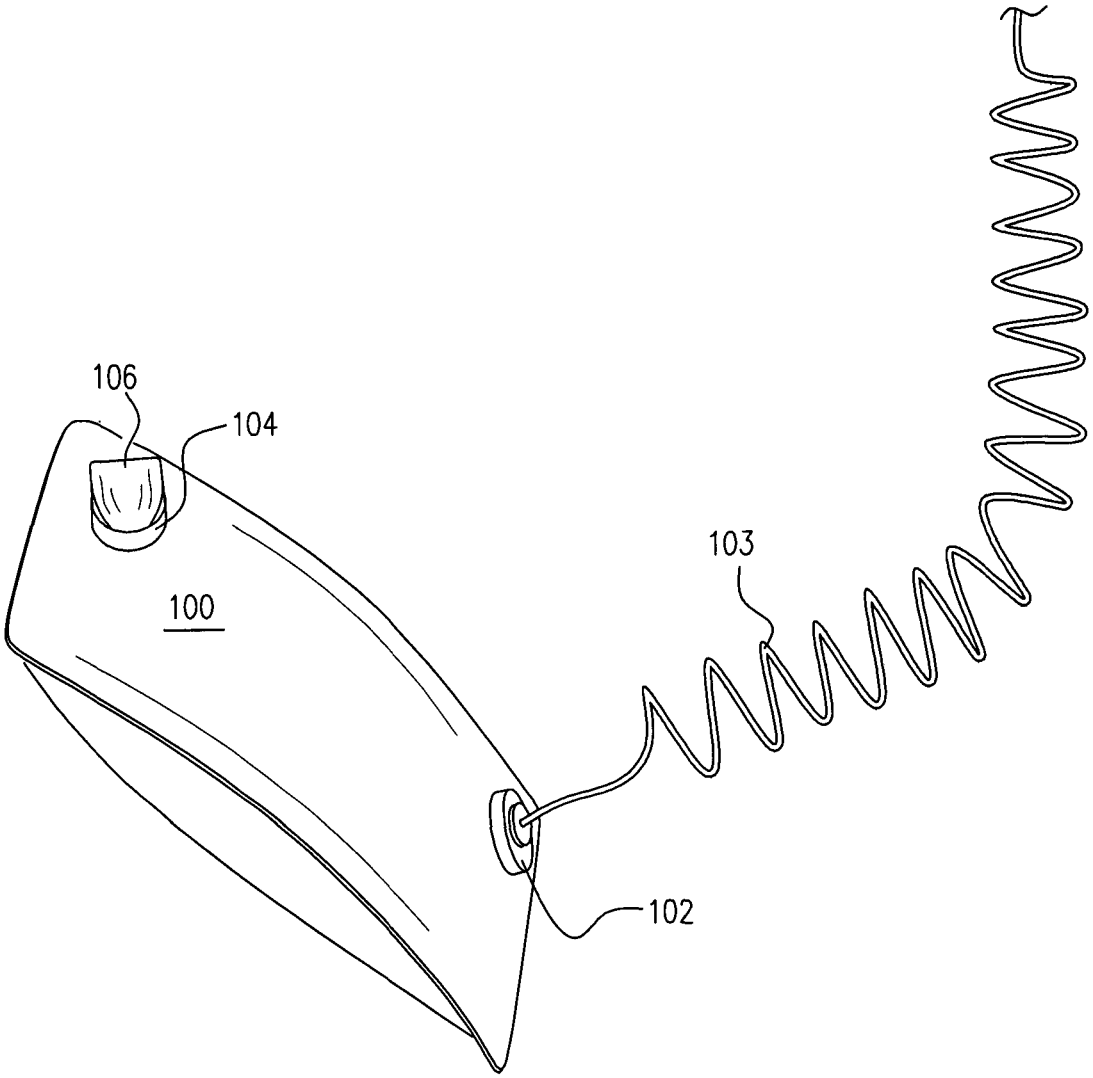
FIG. 1 shows a painting apparatus, according to some exemplary embodiments of the subject matter.

FIG. 1 shows a painting apparatus, according to some exemplary embodiments of the subject matter. The painting apparatus 100 preferably comprises two bags (not shown), a paint bag, which stores paint that is used to paint a surface, and an air bag, which in operation would receive a gas, such as air, said gas will increase the size of the air bag. Since the painting apparatus has a limited ability to expand, the expansion of the air bag will result in pressure being applied to the paint bag. The painting apparatus 100 comprises a paint port 102, through which paint exits the painting bag. In accordance with some embodiments of the subject matter, the paint port 102 is connected to a paint tube 103 through which paint flows from the paint port 102 to a paint accessory (not shown). The paint accessory distributes paint along a surface, for example a wall. In some exemplary embodiments of the subject matter, the paint accessory is a paint roller, a paint brush, a paint spraying device, some other paint distributing apparatus, or the like. The paint bag of the painting apparatus 100 is preferably composed of a flexible plastic material, which enables compression of the painting apparatus 100 to force paint out of the paint bag through the paint port 102. When the paint exits the paint port 102 it flows through the paint tube 103 onto the paint accessory. In some exemplary embodiments of the subject matter, the paint tube 103 may be disconnected from the painting apparatus 100 in order for maintenance and cleaning to enable long use of the painting apparatus 100 with different colors.

The painting apparatus 100 preferably comprises therein an air bag (not shown) which is used for providing pressure on the paint bag, thus allowing a flow of paint from the paint bag through the paint port 102. According to this embodiment, it is the expansion of the air bag that causes the contraction of the paint bag and the flow of paint therefrom to the paint accessory. Person skilled in the art will appreciate that any other mechanism, which can apply contraction force on the paint bag can be used in the alternative to drive the paint out of the paint bag. The air bag is preferably composed of an elastic material such as elastic polymer, rubber, or any other elastic material that enables the air bag to expand when gas, such as air is pumped there into. The air bag therefore acts as a balloon expanding while the air volume therein increases and applying pressure to the paint bag. The air bag is partially or fully attached to the paint bag, for example having a mutual sidewall or another shared surface (not shown). When air is pumped into the air bag, the air bag expands and applies pressure onto the paint bag. If the paint port 102 is open, paint will flow from the paint bag through the paint tube 103. The air bag further comprises an air port 104 through which air enters the air bag. In some exemplary embodiments of the subject matter, the air port 104 is connected to a pumping mechanism 106, which pumps air into the air bag. The pumping mechanism can be mechanical, electrical, motorized, manual or the like device for pushing air into the air bag. In some exemplary embodiments, the pumping mechanism 106 is mechanical and is activated by a motor (not shown). In some cases, a unidirectional valve (not shown) is disposed onto the air port 104 or between the pumping mechanism 106 and the air port 104, to prevent the air from exiting the air bag 116. In some cases, a sensor (not shown) is disposed between the pumping mechanism 106 and the interior side of the air bag 116, to measure the gas pressure within the air bag 116. The pumping mechanism 106 is activated when the gas sensor of the pumping mechanism 106 receives indication that the gas pressure within the air bag is below a predetermined level. In other cases, the sensor can be disposed within the pumping mechanism 106.

The paint bag and the air bag may be of different sizes, according to the necessity of the user. For example, where the user of the painting apparatus 100 is painting a wall of a house, the paint bag may have a capacity to hold at least one liter of paint. The air bag would have to be of a size that would enable a fully inflated air bag to substantially empty the paint bag. According to such embodiment, the air bag will be comprised of sufficient flexible material enabling it to expand such that most or nearly all of the paint in the paint bag can be squeezed out therefrom.

Figure 2:
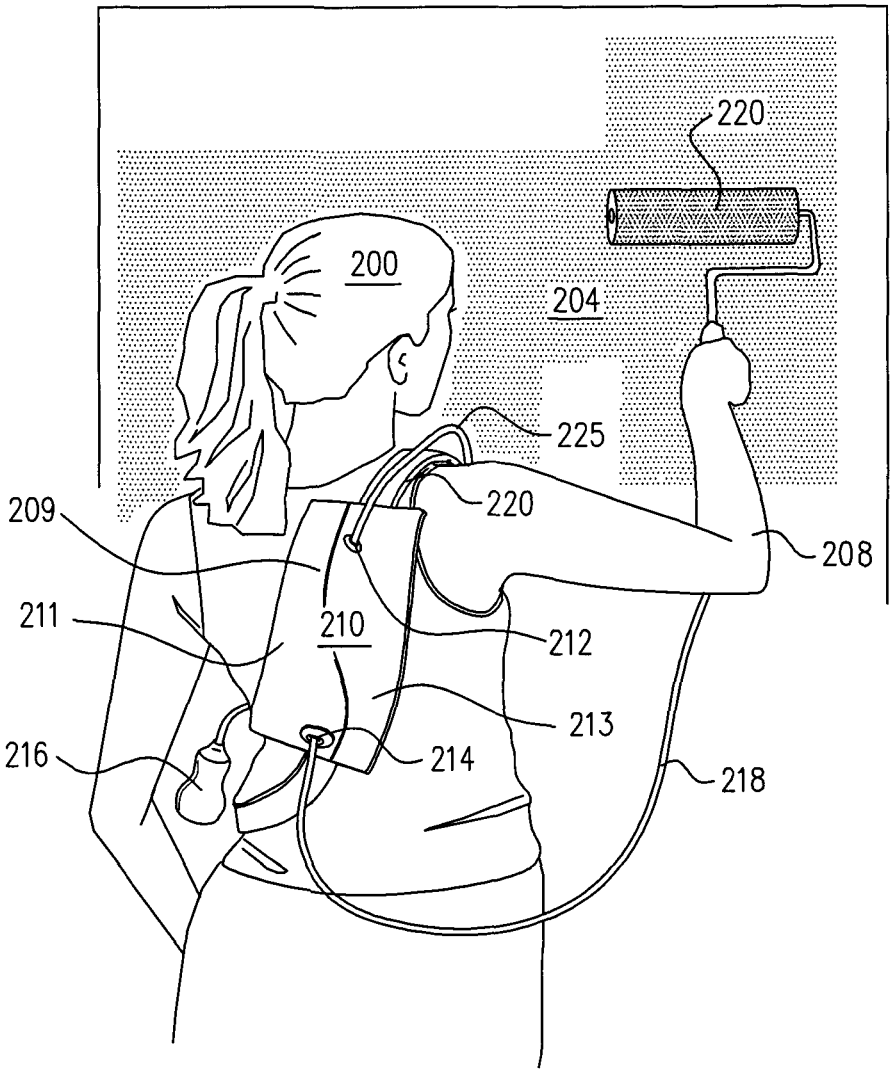
FIG. 2 shows a user using a painting apparatus, according to some exemplary embodiments of the subject matter.

FIG. 2 shows a user using a painting apparatus, according to some exemplary embodiments of the subject matter. The user 200 of the painting apparatus 210 carries the painting apparatus 210, for example, on the user's back. In other embodiments of the subject matter, the painting apparatus can be worn with a strap on the waist or on a limb or placed next to the user 200. The painting apparatus 210 comprises shoulder straps 202 that the user 200 wears when carrying the painting apparatus 210. The user 200 holds a paint accessory 220, for example a paint roller, connected to the painting apparatus 210 in her hand 208 via a paint tube 218. The paint accessory 220 is pressed against a surface 204, such as a wall, to distribute paint onto the surface 204. As seen in FIG. 2, a pumping mechanism 216, such as a mechanical pump having a squeezing or pressing element, is used to introduce air into the painting apparatus 210. In action, the pumping action is performed when the user's presses the pumping mechanism 216, and air is pumped through air port 212 into an air bag 213. As the air enters the air bag 213, the air bag 213 expands applying pressure on a paint bag 211 of the painting apparatus 210. As the paint bag 211 is compressed by the expansion of the air bag 213 paint exits through a paint port 214. The paint flows from the paint port 214 through a paint tube 218 to the paint accessory 220. In the present FIG. 2, air bag 213 and paint bag 211 are shown and for the purpose of explanation are divided by figurative line 209, though in practice the air bag 213 and paint bag 211 will be provided within painting apparatus 210, and while air bag 213 increases in size, paint bag 211 will decrease in size as paint is pushed out therefrom through paint port 214.

Using gas, such as air, to control the flow of paint to the paint accessory 220 enables the continuous painting with the paint accessory 220 while providing paint such that the user 200 does not have to stop painting in order to apply paint onto the paint accessory 220. The painting environment is cleaner and does not require carrying around heavy equipment such as paint buckets and trays, which are bulky, messy and heavy.

In some exemplary embodiments of the subject matter, the pumping mechanism 216 may employ a mechanical force. In some other cases, the pumping mechanism 216 may be a lever (not shown), which the user 200 of the painting apparatus 210 moves or pushes to pump gas into the air bag 213. In some exemplary cases, the pumping mechanism 216 comprises a pump, such as a balloon nozzle which may be operated using the user's limb. When the pumping mechanism 216 is pressed or squeezed, gas, such as air is pumped into a control tube 225 through openings (not shown), which are located on the control tube 225. When the pumping mechanism 216 is pressed, the openings allow gas to enter the control tube 225 and to flow into the air bag 213. In some other embodiments of the present subject matter the control tube 225 may be constructed so as to limit the amount of gas which is pumped into the air bag 213 so as to avoid excessive pressure applied to the paint bag 211. The gas entering the air bag 213 causes the air bag 213 to expand, which compresses the paint bag 211. The compression of the paint bag 211 causes paint to be pushed out of the paint bag 211 into the paint tube 218 towards the paint accessory 220.

Figure 3A:
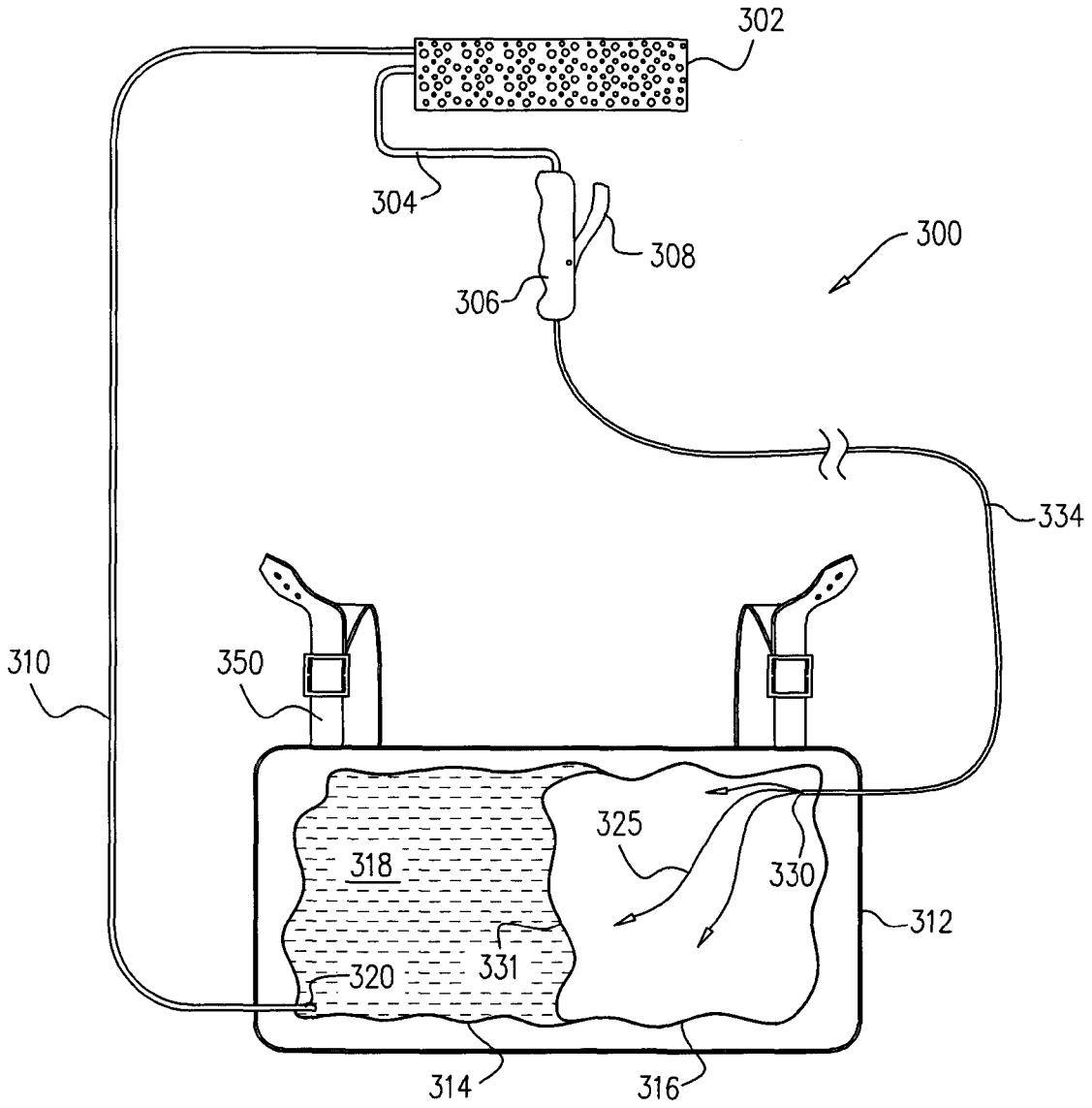
FIG. 3A-3B show a painting apparatus, according to some exemplary embodiments of the subject matter.

FIG. 3A shows a schematic painting apparatus, according to some exemplary embodiments of the subject matter. The painting apparatus 300 comprises a paint accessory 302, which distributes paint along a surface, for example a wall. For example, the paint accessory is a paint roller, paint brush, or the like. The paint accessory 302 is connected to a handle 306 by a connector 304. The handle 306 is used by a user of the painting apparatus 300 when painting an object. In some cases, the paint accessory 302 may be disconnected from the painting apparatus 300 and replaced with a different paint accessory. For example, a user of the painting apparatus 300 is using a paint roller to paint large areas on a surface and then removed the paint roller and connects a paint brush to the painting apparatus to perform finishing touches such as corners. The painting apparatus 300 comprises a compartment 312 that comprises a paint bag 314. The paint bag 314 is composed out of an elastic polymer such as elastic plastic, rubber, or any other elastic materials. The paint bag 314 comprises paint 318, such as acrylic paint, oil based paint, wood protective paint, or the like. A paint tube 310 connects the paint bag 314 to the paint accessory 302. The paint tube 310 is composed of a flexible polymer material. In some exemplary embodiments of the subject matter, the paint tube 310 may be disconnected from the painting apparatus 300 in order for maintenance and cleaning to enable long use of the painting apparatus 300 with different colors. The paint tube 310 comprises a paint tube opening 320 through which the paint 318 enters the paint tube 310 to flow to the paint accessory 302. The compartment 312 further comprises an air bag 316, which is used for holding a gas 325. The air bag 316 is composed out of an elastic polymer such as an elastic polymer, rubber, or any other elastic material that enables the air bag 316 to expand when gas 325 is pumped into the air bag 316, such that it may fully expand to provide such pressure that will force substantially all of the paint 318 from paint bag 314. In some embodiments of the subject matter, the air bag 316 and paint bag 314 are both located within compartment 312 but are separated one from the other. In some other embodiments of the subject matter the air bag 316 may be attached to a part or the whole or part of one or more of the walls of compartment 312. In some embodiments of the subject matter the paint bag 314 may be attached to a part or the whole or part of one or more of the walls of compartment 312. In other embodiments of the subject matter, the air bag 316 is connected or partially connected to the paint bag 314, for example having a mutual portion or whole side wall or another shared surface 331. It will be understood that any attachment material can be used and any form of attachment between the bags and/or walls can be used so as to best achieve the goals of the subject matter. When gas is pumped into the air bag, results in the air bag 316 expending and pressure is applied onto the paint bag 314. The paint bag 314 will then compress and decrease in size as a result and paint 318 is squeezed or forced out of the paint bag 314 through the paint tube opening 320. In some cases, a unidirectional valve 330 is disposed in the control tube 334, preventing the gas 325 from exiting the air bag 316 after it has been pumped there into.

In some cases, the handle 306 comprises a mechanical pumping mechanism 308, which when pressed by the user of the painting apparatus 300 causes the gas 325 to be pumped into the air bag 316. The pumping mechanism may work mechanically. In some other cases, the mechanical pumping mechanism 308 may be a lever, which the user of the painting apparatus 300 presses to pump the gas 325 into the air bag 316. In yet other exemplary cases, the pumping mechanism comprises a pump (not shown) having a balloon nozzle, which may be operated using the user's hand or foot. The mechanical pumping mechanism 308 is connected to the air bag 316 by a control tube 334, which pushes gas 325 into the air bag 316. When the pumping mechanism 308 is pressed, gas 325 is pumped into the control tube 334 through openings (not shown), which are located on the control tube 334 allowing gas 325 to enter the control tube 334 and to flow into the air bag 316. The gas 325 entering the air bag 316 causes the air bag 316 to expand, which compresses the paint bag 314. The compression of the paint bag 314 causes paint to be pushed out of the paint bag 314 into the paint tube 310 towards the paint accessory 302. As is further described in connection with other embodiments of the subject matter, in yet other embodiments, the pumping mechanism 308 is operated by a motorized pump (not shown).

Figure 3B:
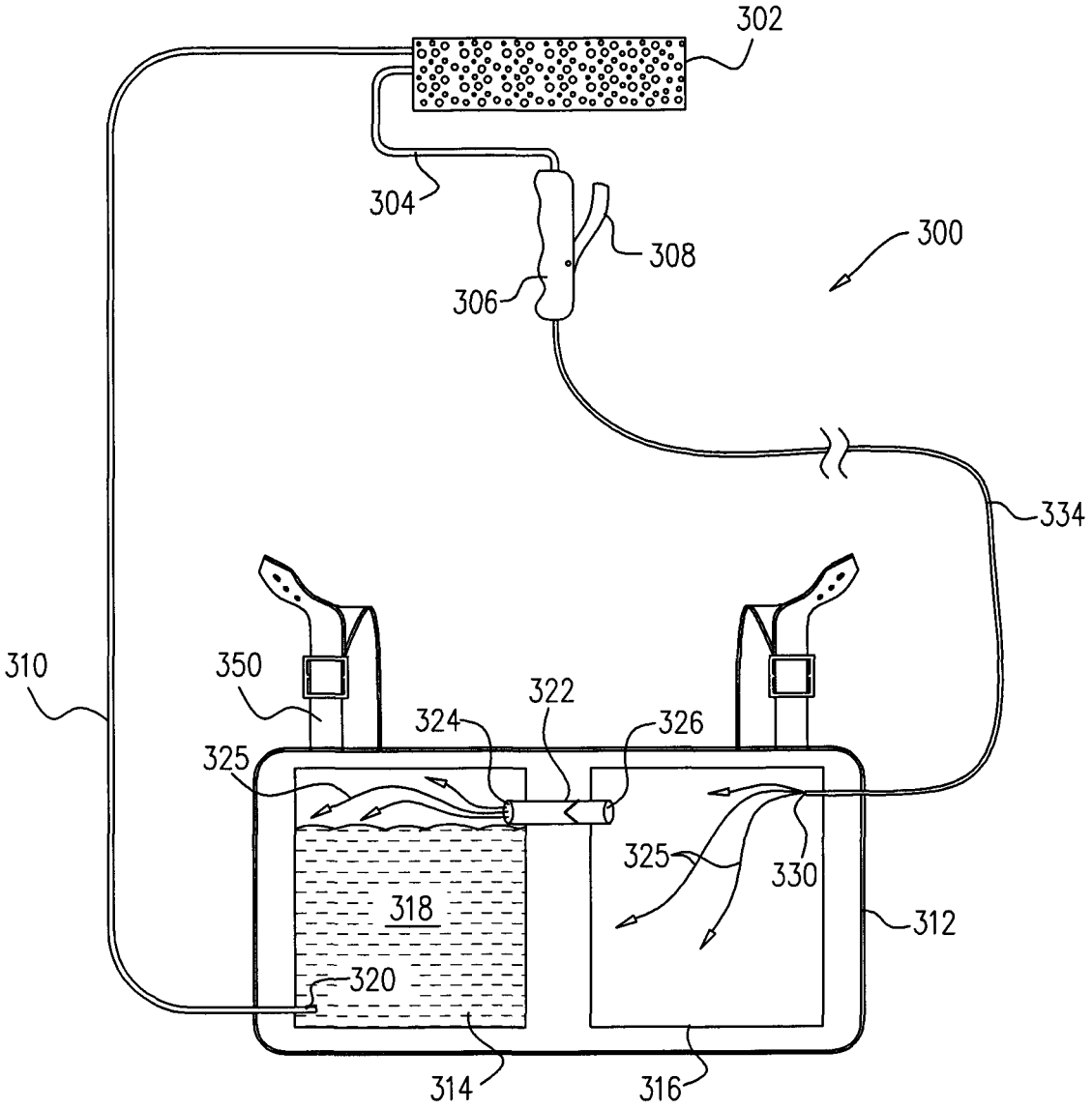

FIG. 3B shows another exemplary embodiment of the painting apparatus 300, according to some exemplary embodiments of the subject matter. The mechanical pumping mechanism 308 pumps the gas 325 into the air bag 316, which enables the gas 325 in the air bag 316 to flow into the paint bag 314. The gas 325 in the air bag 316 flows through an air tube 322 into the paint bag 314. The gas 325 enters the air tube 322 through a first opening 326 and enters the paint bag 314 through a second opening 324. The pressure caused by the gas 325 entering the paint bag 314 forces paint 318 into the paint tube 310 and to the paint accessory 302.

Figure 4:
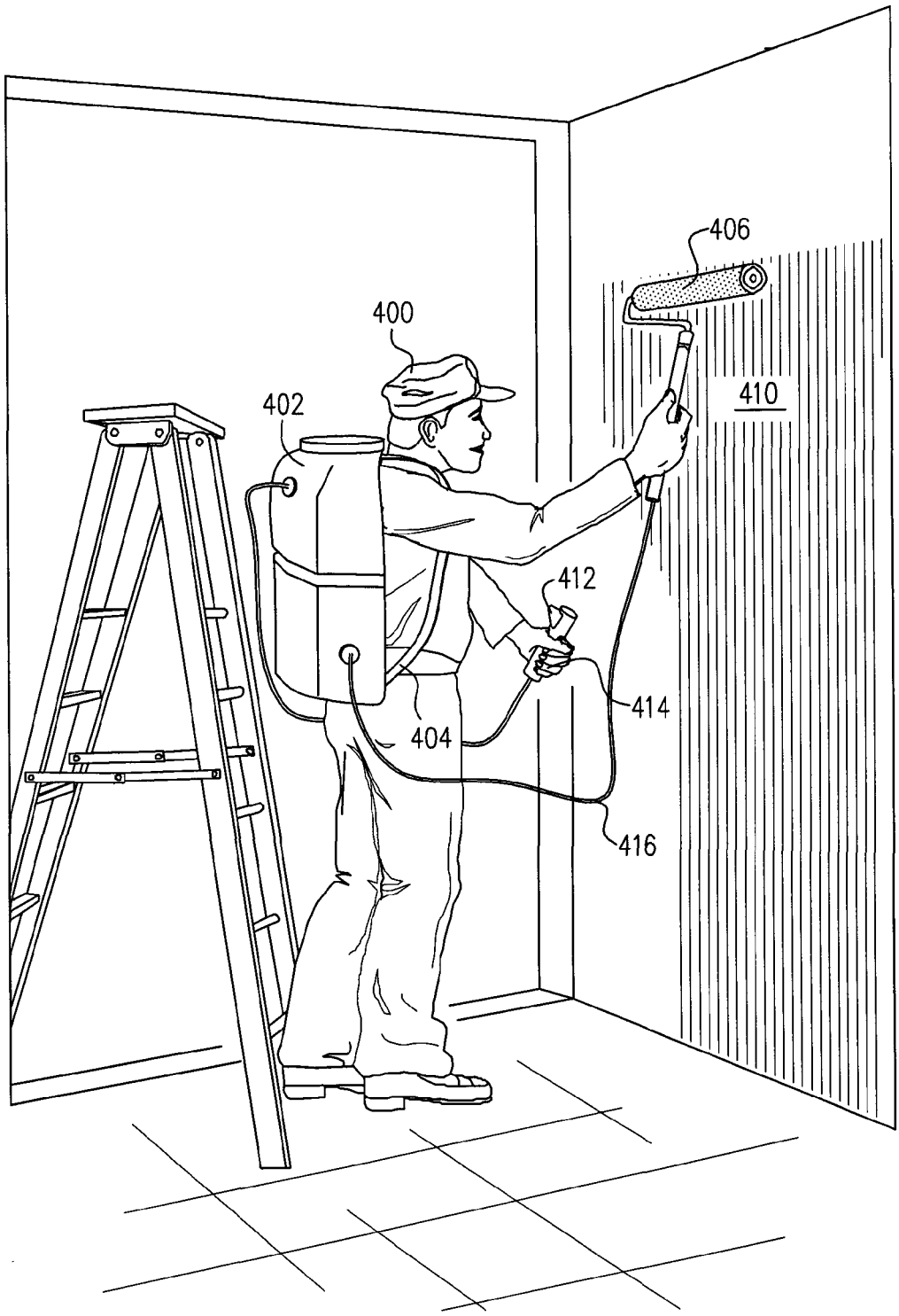
FIG. 4 shows a person using a painting apparatus, according to some exemplary embodiments of the subject matter.

FIG. 4 shows a person using a painting apparatus, according to some exemplary embodiments of the subject matter. The user 400 of the painting apparatus 402 carries the painting apparatus 402, for example, on the user's back. The painting apparatus 402 comprises shoulder straps 404 that the user 400 wears when carrying the painting apparatus 402. The user 400 holds a paint accessory 406, for example a paint roller, of the painting apparatus 402 in his hand. The paint accessory 406 is pressed against a surface 410, such as a wall, to distribute paint onto the surface 410. In some exemplary embodiments of the subject matter, the user 400 holds a lever 412 in a second hand 414. The lever 412 is used to control the pumping action which is configured to push gas from the air bag 316 of FIG. 3 into the paint bag 314 of FIG. 3. The air entering the paint bag pushes paint through a paint tube 416 to the paint accessory 406. Using air to control the flow of the paint to the paint accessory 406 enables the continuous painting with the paint accessory 406 while providing paint such that the user 400 does not have to stop painting in order put paint onto the paint accessory 406. The use of a control to control the pumping action can be applied to the other embodiments of the subject matter. Such control can be mechanical, such as a lever with a spring, electric, such a s a button to turn off an electrical pump or the like.

Figure 5:
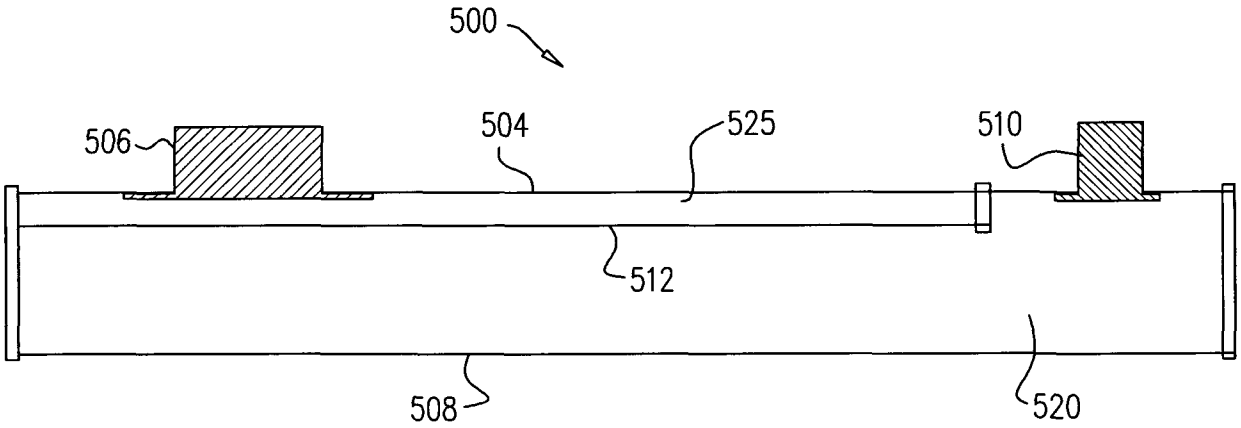
FIG. 5 shows a side view schematic layout of a painting apparatus, according to some exemplary embodiments of the subject matter.

FIG. 5 shows a side sectional and schematic view layout of a painting apparatus, according to some exemplary embodiments of the subject matter. The paint apparatus comprises a compartment 500 comprising a paint bag 525 and airbag 520. The compartment 500 comprises a paint port 506 on a top layer 504. The top layer 504 is a membrane of the paint bag 525 of the compartment 500. A bottom membrane 508 of the compartment 500 comprises an air port 510. The bottom membrane 508 is a portion of the airbag 520 of the compartment 500. A separation wall 512 separates the paint bag 525 and the airbag 520. The separation wall 512 may be composed of an elastic material, such as rubber, elastic polymer, plastic and the like. In some embodiments of the subject matter, the separation wall may comprise of two layers which are connected there between in some or throughout its length. As gas enters the air port 510, the airbag 520 expands applying pressure via the separation wall 512 onto the paint bag 525. As the separation wall 512 pushes and compresses space in the paint bag 525 paint exits the paint bag through the paint port 506.

Figure 6A:
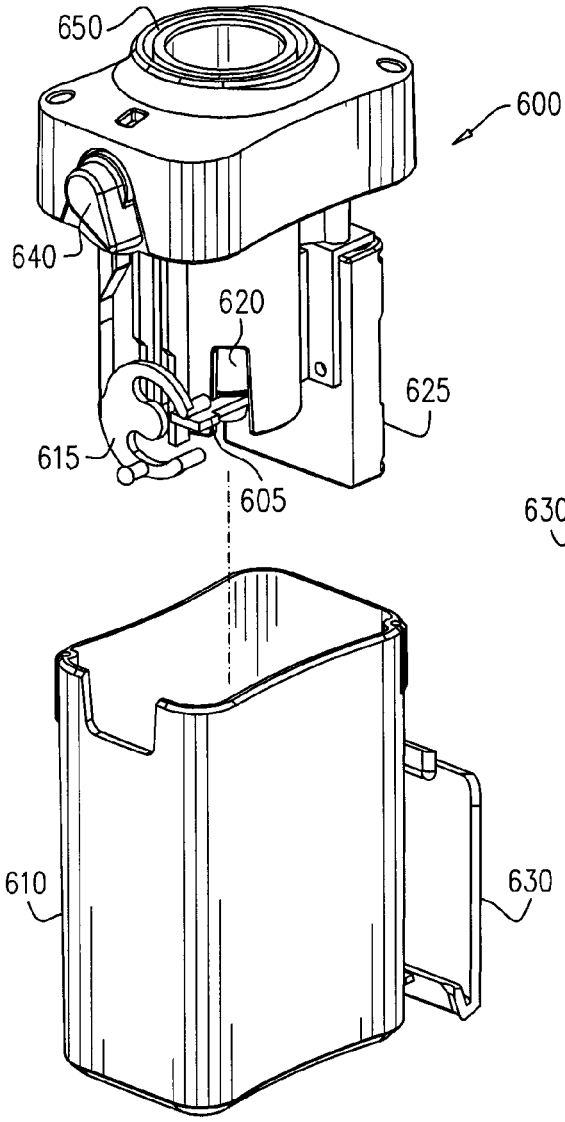
FIGS. 6A-6B show a mechanical pump for filling an airbag of a painting apparatus, according to some exemplary embodiments of the subject matter; and, FIGS. 7A-7B show a stopper for a paint opening of a painting apparatus, according to some exemplary embodiments of the subject matter.
Figure 6B:
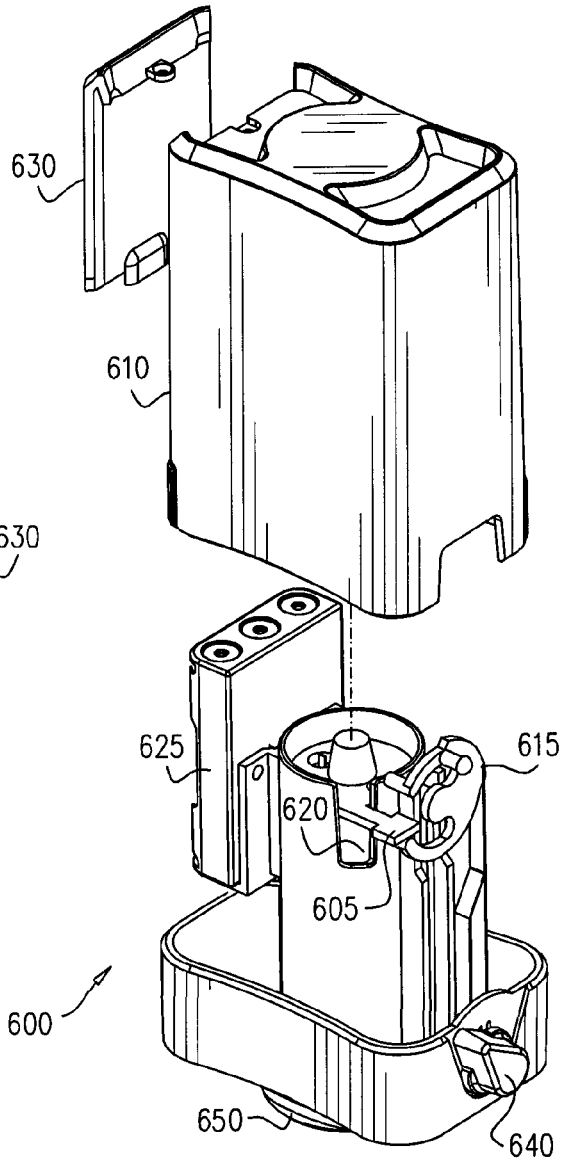

FIGS. 6A-6B show a pump device for filling an airbag of a painting apparatus, according to some exemplary embodiments of the subject matter. The painting apparatus 500 of FIG. 5 comprises an air port 510 of FIG. 5 through which air enters the air bag 520 of FIG. 5. The pump device 600 is connected to the air port 510, for example pump port 650 includes grooves and is applied to the air port 510 through a rotating motion as a plug. The pump device 600 is comprises a pump port 650, which is inserted into or connected with the air port 510 such that the pump port 650 seals the air port 510 and prevents gas from leaking out of the air port 510. The pump device 600 may comprise a button 630 for opening and closing a lid 610 of the pump device 600. The pump device 600 comprises an electrical pump 620, which pumps air into the air port 510. The pump device 600 comprises an energy source 625, for example batteries, which powers the electrical pump 620. The power source 625 may be replaceable when it runs out of power, i.e. batteries. When the power source must be replaced, the lid 610 is removed to enable access to the power source 610 to remove old batteries and insert new ones. The pump device 600 comprises an activation switch 640, which enables a user of the painting apparatus 500 to activate the pump device 600 when the user is painting. In some cases, the activation switch 640 is a flip-flop switch, which turns on or off the pump device 600. The pump device 600 comprises a pressure control mechanism 605, which measures the gas pressure of the gas pumped through the electrical pump 620 into the air port 510. The pressure control mechanism 605, may be a mechanical unit which moves as the gas pressure decreases in the air bag 520, for example moving down. In some non-limiting cases, the pressure control mechanism 605 may comprise a sensor (not shown) indicating the gas pressure at the air port 510. The pump device 600 comprises an electric switch 615, which activates and deactivates the electrical pump 605 according to the pressure measured by the gas pressure control mechanism 620. As the pressure in the air bag 520 decreases, the pressure control mechanism 620 moves a predetermined distance to indicate a reduction of the gas pressure in the air bag 520. When the pressure control mechanism reaches 620 moves a predetermined distance, the electric switch 615 activates the electric pump 620. For example, the pressure control mechanism 620 moves the predetermined distance of 10 mm, which indicates that the gas pressure in the air bag 520 is lower than a predetermined pressure, such as 0.3 ppm. The electric switch 615 activates the electrical pump 605, causing air to flow into the air bag 520. The air flowing into the air bag 520 increases the gas pressure in the air bag 520 resulting in the pressure control mechanism 605 moving to a pressure control mechanism's starting location. When the pressure control mechanism 620 reaches the pressure control mechanism's starting location, the electric switch 615 deactivates the electrical pump 605, thus stopping the flow of gas through the air port 510. The pressure within the air bag 520 reduces when paint exits the air bag 520 allowing more space for the air bag 520 to expand thereto and hence the pressure in the air bag 520 decreases as paint exists through paint port 506 of FIG. 5.

Figure 7A:
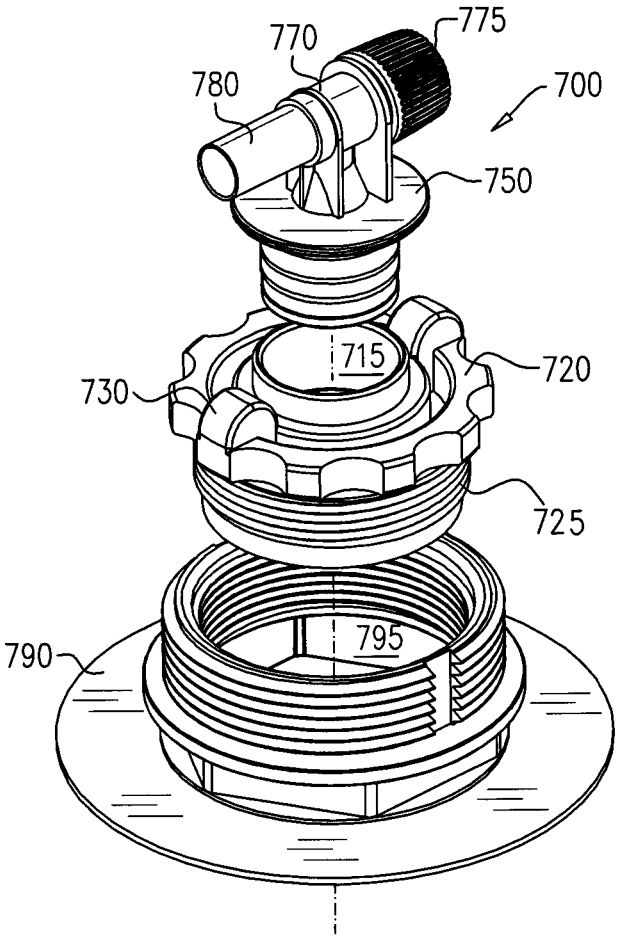

FIG. 7A shows a stopper for a paint opening of a paint apparatus, according to some exemplary embodiments of the subject matter. The stopper 700 is a cover of a paint port 790, which provides a convenient arrangement for attaching the paint tube 218 of FIG. 2, while sealing the paint port 790 to prevent spillage of the paint from the paint bag 525 of FIG. 5. The stopper 700 enables the optimal volume of the paint to exit the paint bag 505 while the painting apparatus 500 of FIG. 5 is in use. The stopper 700 comprises an external stopper 720, which is inserted into a port 795 of the paint port 790. The external stopper 720 may be inserted into the port 795 the paint port 790 using a rotating motion, such as screwing the external stopper into the paint port 790. The external stopper comprises a stopper port 715, through which paint base is filled into the paint bag 525. After the paint bag is filled with the paint base, an internal stopper 750 is inserted into the stopper port 715. The internal stopper 750 is molded to fit into a stopper port 715 of the external stopper 720 such that the internal stopper 750 cannot be removed from the stopper port 715, so to prevent excess spillage of paint from attempts of a user to remove the internal stopper 750. The internal stopper 750 is fitted into the stopper port 715 by the internal stopper 750 being pushed into the stopper port 715 such that the internal stopper 750 cannot be removed from the stopper port 715. The internal stopper 750 is inserted into the stopper port 715 after a paint base is poured into the paint bag 525 during production of the painting apparatus 500.

The internal stopper 750 comprises a paint valve 770, which enables paint to flow out of the paint bag 525 into the paint tube 218. The paint valve 770 comprises a valve paint tube 780, which is inserted into the paint tube 218, to enable the paint to flow into the paint tube 218 without causing a leak. When the paint tube 218 is connected to the valve paint tube 780, the paint flowing through the valve paint tube 780 flows into the paint tube 218, which flows the paint to the paint accessory 220 of FIG. 2. The paint valve 770 comprises a valve knob 775, which enables controlling the amount of paint that flows through the paint valve 770 into the paint tube 218. The valve knob 775 enables closing the paint valve 770 to enable attachment or removal of the paint tube 218 without causing spillage of the paint from the paint bag 525. The closing of the paint valve 770 further enables easily transporting the painting apparatus 500 without having the paint tube 218 and paint accessory 220 connected to the painting apparatus 500, and without paint leaking out of the paint bag 525.

The external stopper 720 comprises a spiraled molding 725, such as grooves, to enable inserting the external stopper 720 into the paint port 790 though a circular motion. The external stopper 720 is inserted into the paint port 790 by rotating the external stopper 720 into the paint port 506 until the external stopper 720 is tightly connected to the paint port 506. When the user purchases the painting apparatus 500, the user selects a color with which to paint. The paint color is then added to the paint base already in the paint bag 790. The stopper 700 is removable from the paint port 790 when paint color is added to the paint base already in the paint bag 525. Once the paint color is added, the stopper 700 is tightly inserted back into the paint port 506 using a rotating motion, i.e. twisting motion, to enable mixing the contents of the paint bag 525 to make the paint ready for use. The mixing is performed using a paint mixer. To prevent paint from spilling from the paint bag 525, the stopper 700 is tightly inserted into the paint port 790. Once the mixing is performed, the painting apparatus 500 is prepared to be used for painting.

Figure 7B:
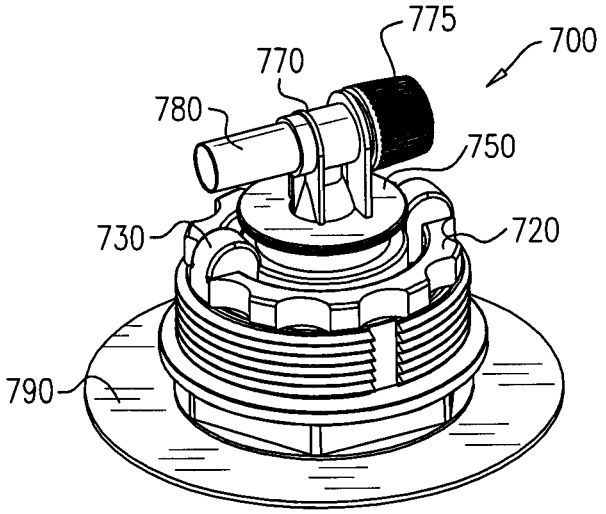

FIG. 7B shows the internal stopper 750 inserted into the external stopper 720, according to some exemplary embodiments of the subject matter. The internal stopper 750 is inserted into the external stopper 720 by applying a strong force to insert the internal stopper 750 into the external stopper port 715. It should be noted that insertion of the internal stopper 750 into the external stopper 720 occurs during production of the painting apparatus 500 after which the internal stopper 750 cannot be removed from the external stopper 720. The internal stopper 750 cannot be removed and prevents any leaking of the paint from the external port 720.

While the disclosure has been described with reference to exemplary embodiments, it will be understood by those skilled in the art that various changes may be made and equivalents may be substituted for elements thereof without departing from the scope of the subject matter. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. A painting apparatus comprising:

a flexible paint bag containing paint;

a paint port through which paint flows from the paint bag;

a flexible air bag to receive gas configured to apply pressure to the paint bag as it receives air;

an air port through which the gas enters the air bag;

a flexible top membrane of the painting apparatus, said flexible top membrane is a portion of the paint bag and of the air bag, wherein the paint port is positioned on the flexible top membrane;

a flexible bottom membrane of the painting apparatus, said bottom membrane is a portion of the flexible air bag;

a separation wall separating the paint bag and the airbag, said separation wall is composed of an elastic material;

wherein the airbag expands as gas enters the air port, applying pressure via the separation wall onto the paint bag; and, wherein said flexible paint bag enables compression of the painting apparatus, and only the expansion of the separation wall applies pressure onto the flexible paint bag to compress space in the paint bag resulting in the paint exiting the paint bag through the paint port.

2. The painting apparatus of claim 1, further comprising a paint tube to convey paint from the paint port to a paint accessory that distributes the paint onto a surface.

3. The painting apparatus of claim 1, further comprising a paint accessory to distribute paint onto a surface.

4. The painting apparatus of claim 1, further comprising a pressure valve connected to the air port, wherein the pressure valve is opened or closed depending on the pressure of the gas within the air bag.

5. The painting apparatus of claim 1, further comprising a mechanical pump having a pressing element, said mechanical pump is used to introduce air into the air bag.

6. The painting apparatus of claim 1, further comprising a pump device connected to the air port to introduce air into the air bag, said pump device comprising:

a pump for pumping the gas via the air port into the air bag;

an electric switch to activate and deactivate the pump;

an energy source;

an pressure control mechanism that moves according to gas pressure in the air bag;

wherein the electric switch activates the pump when the pressure control mechanism moves a predetermined distance.

7. The painting apparatus of claim 6, wherein the electric switch is activated at predetermined time increments.

8. The painting apparatus of claim 6, wherein the pump device comprising an activation switch to enable activation of the pump device.

9. The painting apparatus of claim 6, wherein the electric switch deactivates the pump when the pressure control mechanism is at a pressure control mechanism original location.

10. The painting apparatus of claim 1, further comprising a shoulder straps for carrying the painting apparatus.

11. The painting apparatus of claim 1, wherein the separation wall is composed of an elastic material.

12. The painting apparatus of claim 1, wherein the separation wall is a mutual portion of the flexible paint bag and the flexible air bag.

* * * * *